United States Patent [19]

McMahan, Sr.

[11] 4,247,072

[45] Jan. 27, 1981

[54] SWIVELED ROCKER BOX AND BASE

[75] Inventor: Roy F. McMahan, Sr., Louisville, Ky.

[73] Assignees: Roy F. McMahan, Jr.; William L. McMahan, both of Louisville, Ky.

[21] Appl. No.: 840,482

[22] Filed: Oct. 3, 1977

[51] Int. Cl.[2] ..... A45C 3/00

[52] U.S. Cl. ..... 248/582; 248/425; 248/188.9

[58] Field of Search ..... 248/375, 378–385, 248/425, 188.7, 188.8, 188.9, 582; 297/326

[56] References Cited

U.S. PATENT DOCUMENTS

| | | | |
|---|---|---|---|
| 165,718 | 7/1875 | Doremus | 248/375 |
| 356,222 | 1/1887 | Donovan | 248/375 X |
| 929,272 | 7/1909 | Baron | 248/385 |
| 2,184,988 | 12/1939 | Collier et al. | 248/375 |
| 2,339,953 | 1/1944 | Schlorman | 248/382 |
| 3,263,955 | 8/1966 | Hunt et al. | 248/385 |
| 4,014,086 | 3/1977 | Doerner | 248/381 X |
| 4,025,020 | 5/1977 | Goff et al. | 248/385 |

FOREIGN PATENT DOCUMENTS

| | | | |
|---|---|---|---|
| 2022525 | 11/1971 | Fed. Rep. of Germany | 248/375 |
| 88361 | 7/1920 | Switzerland | 248/188.9 |
| 4073 | of 1888 | United Kingdom | 248/188.9 |

*Primary Examiner*—Lawrence J. Staab
*Attorney, Agent, or Firm*—Maurice L. Miller, Jr.

[57] ABSTRACT

A rocker box for furniture and the like, comprising: a rockable top plate having two pairs of parallel laterally-spaced outer-depending side and inner-depending supplementary flanges containing perforations cooperatively providing four pivot-receiving openings on a common transverse axis, one outer side and one inner supplementary flange being located at each of the opposite sides of the box, each inner supplementary flange being spaced inwardly from the corresponding outer side flange so as to cooperate therewith in delimiting an interposed upper flange space; a non-rockable bottom plate having one pair of parallel laterally-spaced outer upright side flanges, one for each upper flange space, each upright side flange projecting upwardly from the bottom plate into the corresponding upper flange space where it is parallel to the corresponding depending side and supplementary flanges, said pair of upright flanges cooperatively providing two more pivot-receiving openings on said common transverse axis; and a pair of laterally-spaced flange-interconnecting pivotal structures mounting the top plate upon the bottom plate for rocking movement out of a neutral position between extreme forward and rearward rocking positions, one pivotal structure at each side of the box, each structure including a bushing mounted on the upright flange and a top plate pivot pin within the bore of each bushing; and front and rear rubber blocks between plates.

14 Claims, 18 Drawing Figures

SWIVELED ROCKER BOX AND BASE

CROSS REFERENCES TO RELATED APPLICATIONS

A related application has not been filed.

BACKGROUND OF THE INVENTION

1. Field of the Invention

This invention relates to swiveled rocker boxes which are widely used for rotationally and rockably supporting a chair seat upon a chair base.

2. Description Of The Prior Art

In the prior practical art, the top and bottom plates of the rocker box are each provided with a single side flange at each side and pivotally connected for top plate rocking movement by a pair of pivot pins, one extending through each pair of adjacent top and bottom side flanges. Nylon bushings are sometimes used to provide frictionless bearings at the pivot points and to promote quiet operation by preventing metal-to-metal contact. Such rocker boxes are universally swiveled on an underlying base plate. So far as I know, all such structures in wide use are subject to plate breakage due to flexure and such breakage occurs with sufficient frequency to present a serious long standing problem.

The Hunt et al U.S. Pat. Nos. 3,263,955, Gordon 3,547,393, Joyce 3,881,713 and Goff 4,025,020 all show rocker boxes in which the top and bottom plates are flanged at the sides but not the ends. Craig U.S. Pat. No. b 3,938,857 shows a rocker box flanged at the front and rear ends adjacent its corners. The Engstrom U.S. Pat. Nos. 2,528,949, Matthews 2,779,642 and Battochio 3,491,978 show rocker-boxes on a base swivel plate, the periphery of which is continuously flanged for bottom bearing-race-forming purposes. The Wing U.S. Pat. Nos. 3,193,335 and the Hunt et al 3,263,955 show rocker box structures using a Nylon bushing to prevent metal-to-metal contact in the pivotal structure, which was subject to wear and resultant looseness. The Asmanes U.S. Pat. Nos. 3,418,027 and the Rehrig 3,837,039 use a Teflon bushing for bearing purposes in rotary structures. The Doremus U.S. Pat. Nos. 135,974 and Collier et al 2,184,988 show rubber blocks for cushioning the rocking movement of an oscillatable chair. The U.S. Pat. Nos. to McIlhenny 412,199, Shanahan 755,713, Rosenthal 1,690,754, Schermerhorn 2,103,095, O'Connor 2,543,592 and Kahn 2,699,814 all show rubber blocks and like devices secured to the bottom ends of the legs of ladders, and chairs for anti-slip purposes.

SUMMARY OF THE INVENTION

Objects of the Invention

The main objective of the present invention is to provide, at a competitive price, a rugged rocker box which resists wear and plate flexure sufficiently to promote long life.

Another important objective is to provide a long lasting rocker box which is extremely smooth and quiet in operation and, preferably, one which can be conventionally swiveled at conventional cost.

A further object is to provide a swiveled rocker box on a floor-engaging base structure having novel inexpensive long lasting floor-engaging glides.

STATEMENT OF INVENTION

The main objectives of the present invention are achieved in the rocker-box plates by turning the entire horizontal peripheries of the top and bottom rocker box plates 90° to provide them with endless peripheral rims which increase their resistance to flexure in substantial measure. These endless rails point toward each other, i.e. the top rim depends from the top plate and the bottom rim stands upright on the bottom plate. Both are contoured to provide short flanges at the front and rear of the box and long parallel flanges at the outer sides of the box. Each outer side flange on the upper plate overlaps the corresponding outer side flange on the lower plate to accommodate the corresponding rocker box pivot. Each side of the top plate also has another depending side flange spaced inwardly from the depending outer side flange to effect an additional increase in the resistance to flexure and improvement in the support of the corresponding pivotal structure in the plates.

Other important objectives are achieved by improvements in a pair of pivotal structures, each of which include: a hollow Nylon bushing, having a head at its outer end and a square shank containing a cylindrical bore and including a square neck portion adjacent the head; and a stepped pivot pin having a head at its outer end, a small square shoulder next to the head and a still smaller cylindrical shank. Each Nylon bushing is non-rotatably mounted on the bottom plate to form an integrated bottom unit by fitting its square neck into a square hole in the corresponding upright side flange of the bottom plate so that its head separates the peripheral side flanges of both plates.

Each pivot pin is non-rotatably mounted on the top plate to form an integrated top unit by fitting its square shoulder into a square hole in the corresponding depending peripheral side flange of the top plate with the free end of its cylindrical shank fitting in a circular hole in the adjacent depending inner side flange of the top plate. The integrated top plate unit is rockably mounted on the integrated bottom unit by fitting the pivot pin between top side flanges within the cylindrical bore of the bottom plate bushing.

Smooth quiet operation of the rocker-box is promoted not only by said pivotal structure but also by cushioning such movement with front and rear rubber blocks arranged between the plates. These blocks are in a partially compressed condition when the top plate occupies its neutral position. Forward rocking ease is promoted by tapering the front rubber block.

A rocker box of the foregoing character can be conventionally swiveled on a base plate at conventional cost and conventionally mounted on a supporting structure of the spider-leg type. In further accordance with my invention, opaque floor-engaging Nylon glides are transversely grooved on their bottom sides and rigidly mounted in the downwardly-open channel-like ends of each leg by bending metal tongues from the legs into opposite ends of the transverse groove so as to clamp the glide firmly against the bight of the leg channel.

BRIEF DESCRIPTION OF THE DRAWINGS

The preferred embodiment of my invention is illustrated in the accompanying drawings wherein.

DESCRIPTION OF THE PREFERRED EMBODIMENT

Figure 1:
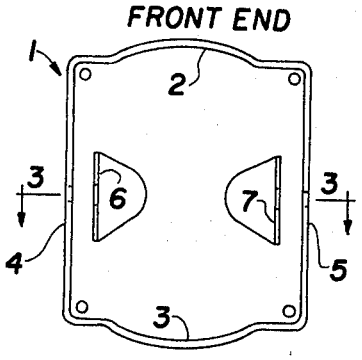
FIG. 1 is a bottom plan view of the top plate of the rocker box (R-B)
Figure 5:
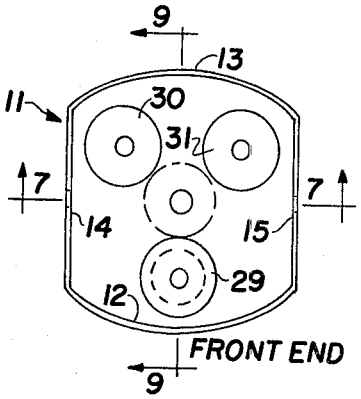
FIG. 5 is a top plan view of the bottom plate of the R-B equipped with three rubber blocks.
Figure 2:
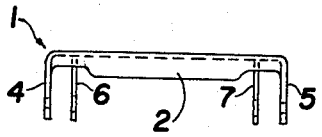
FIG. 2 is a front end elevation of FIG. 1.
Figure 6:
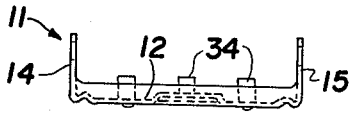
FIG. 6 is a front end elevation of FIG. 5, this view omitting all rubber blocks but showing block retaining pins.
Figure 3:
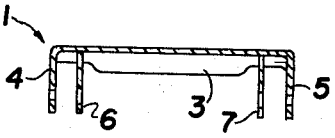
FIG. 3 is a section taken along line 3—3 of FIG. 1.
Figure 7:
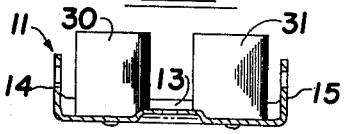
FIG. 7 is a section taken along line 7—7 of FIG. 5.
Figure 4:
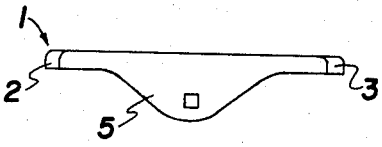
FIG. 4 is a side elevation of the right side of FIG. 1.
Figure 8:
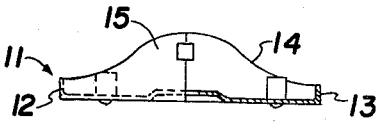
FIG. 8 is a side elevation of the front half of FIG. 5 and a vertical central section of the rear half thereof.

The preferred embodiment of my swiveled rocker box (R-B) on a base supporting structure, as illustrated, specifically includes five elements comprising: the R-B plates; the R-B pivotal structures, the R-B rubber blocks; a plate-type swivel; and a base supporting structure.

Rocker Box Plates

The rocker box plates comprise a pair of horizontal metal plates including a flat topped rockable top plate 1 and a flat bottomed non-rockable bottom plate 11.

The top plate 1 has its entire periphery turned 90° downwardly toward the bottom plate 11 to provide a continuous depending vertical rim which increases the top plate's resistance to flexure in substantial measure. This horizontally endless depending vertical rim is contoured to provide short depending front and rear flanges 2, 3 permitting rocking movement and long depending side flanges 4, 5 to accommodate the rocker box pivots along the transverse rocking axis of the box. The top plate 1 also has a laterally spaced pair of vertically long supplementary inner side flanges 6, 7 depending from its top and preferably struck downwardly out of the body of the flat top plate metal. The outer and inner side flanges 4 and 6 form one cooperative pair of flanges while 5 and 7 form another. All side flanges are parallel to each other while each inner side flange 6 (7) is horizontally spaced a short distance inwardly from the adjacent outer side flange 4 (5). The space, between adjacent outer and inner side flanges of each cooperating pair, is hereinafter called the "flange space". The top plate 1 has corner holes 9 to accommodate screws securing the top plate to the overlying frame of a chair seat or like article.

The bottom plate 11 is smaller than the top plate, e.g., in inches, 6 5/16×6 5/16 vs. $6\frac{3}{4}\times6\frac{3}{4}$. It has its entire periphery turned 90° upwardly toward the top plate 1 to provide a continuous vertical upright rim which is contoured to form short upright front and rear flanges 12, 13 permitting the rocking movement and long upright side flanges 14, 15 to accommodate rocker box pivots along the transverse rocking axis of the box. The bottom plate is dimensioned so that each of its side flanges 14 (15) projects upwardly into the flange space between the corresponding pair of top plate side flanges 4, 6 (5, 7). The outer side flanges 14, 15 of the bottom plate 11 are parallel to each other and to all of the outer and inner side flanges 4–7 of the top plate 1 but each bottom plate flange 14 (15) is laterally spaced from both of the adjacent flanking side flanges 4, 6 (5, 7) on the top plate 1.

R-B Pivotal Structures

Figure 10:
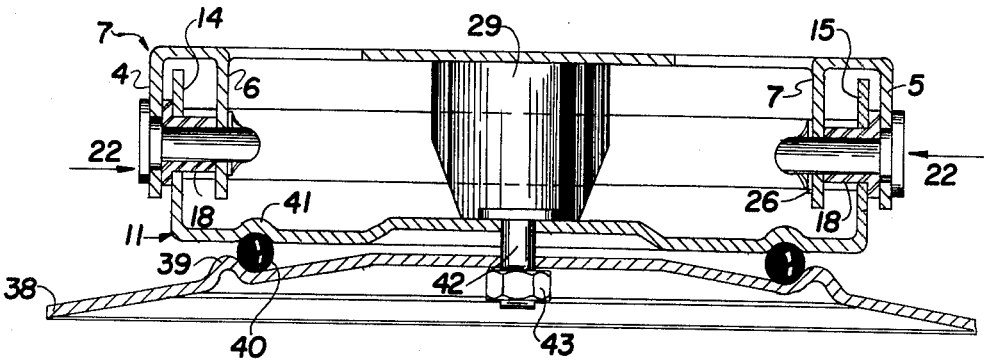
FIG. 10 is a vertical transverse center section of the R-B and swivel corresponding to one taken on line 10—10 of FIG. 9.
Figure 11:
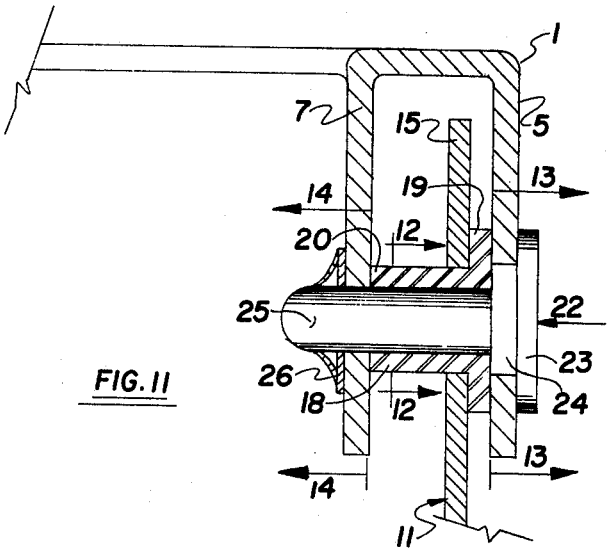
FIG. 11 is an enlarged transverse vertical center section of one pivotal connection of the R-B.
Figure 12:
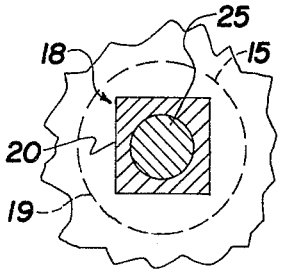
FIG. 12 is a section taken along line 12—12 of FIG. 11.
Figure 13:
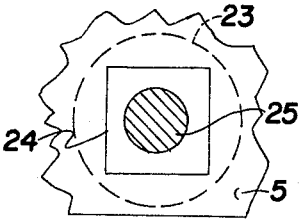
FIG. 13 is a section taken along line 13—13 of FIG. 11.
Figure 14:
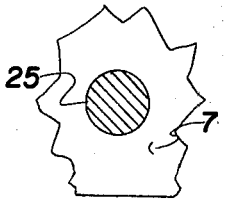
FIG. 14 is a section taken along line 14—14 of FIG. 11.
Figure 15:
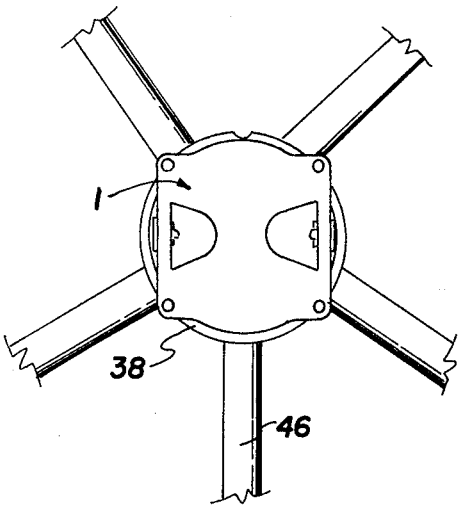
FIG. 15 is a top plan view of a swiveled rocker-box mounted on a floor-engaging base.
Figure 16:
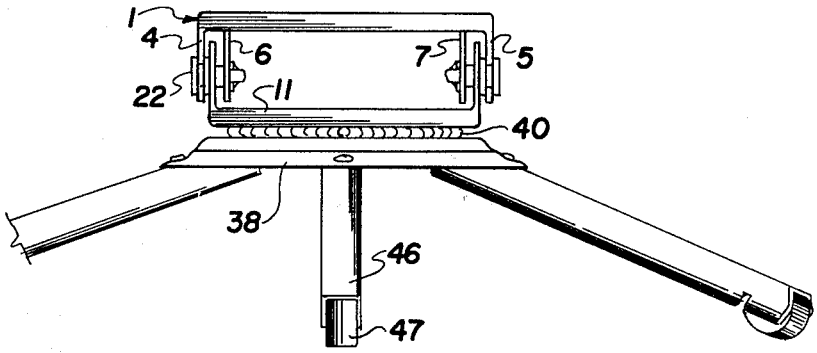
FIG. 16 is a front end elevation of FIG. 15.
Figure 17:
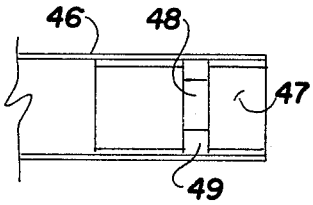
FIG. 17 is a bottom plan view of the floor-engaging end portion of a leg of the base.
Figure 18:
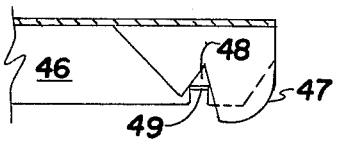
FIG. 18 is a section taken along line 15—15 of FIG. 14.

Two identical R-B structures pivotally mount top plate 1 on bottom plate 11 for rocking movement about the box's rocking axis which passes transversely through aligned axial openings in all side flanges 4–7 on the top plate and 14–15 on the bottom plate. Since both pivotal structures are identical, their corresponding parts will be assigned the same designating numerals but only the pivotal structure shown in FIG. 11 and at the right in FIG. 10 will be described in detail. The right pivotal structure includes: a hollow Nylon bushing 18 for the bottom plate 11; and a solid stepped pivot pin 22 for the top plate 1.

The Nylon bushing 18 has a round head 19 and a square shank 20, which is characterized, in cross-section, by a cylindrical bore and a square periphery. Bushing 18 is mounted on the bottom plate 11 by fitting its square shank 20 in the square axial opening of the bottom side flange 15. The head 19 of the bushing abuts and separates side flanges 5 and 15 while the shank 20 of the bushing bridges the remaining flange space between outer side and inner supplementary flanges 5, 7 of the top plate with the inner end of the shank of the bushing abutting the supplementary side flange 7. This arrangement of the bushing integrates it with the bottom plate and prevents any metal-to-metal contact between the side flange 15 of the non-rockable bottom plate and the outer side and inner supplementary flanges 5 and 7 of the rockable top plate.

The stepped solid pivot pin 22 has a round head 23, an adjacent square shoulder 24 of smaller cross-section than the head and a cylindrical shank 25 of still smaller cross-section. The pin 22 is inserted successively through axially aligned openings comprising: a square hole in outer side flange 5 of the top plate; the cylindrical bore of bushing 18 of the bottom plate; and a circular hole in the supplementary side flange 7. When its head 23 abuts side flange 5, and the free end portion of its shank 25 projects inwardly through and beyond supplementary flange 7, its square shoulder 24 fits snugly within the square axial hole of side flange 5 and its cylindrical shank 25 fits snugly not only within the bore of bushing 18 but also within the circular axial hole of the supplementary flange 7.

With this arrangement, the following things are accomplished, viz: the pin 22 is connected non-rotatably to the top plate 1 by the square shoulder 24; the opposite end portions of pin 22 are carried by the top plate 1 by the engagement of the square shoulder 24 with the side flange 5 and the engagement of cylindrical shank 25 with the supplementary side flange 7; and the integrated top plate and pin unit 1, 22 is supported for pivotal movement on the bottom plate 11 through the rotational engagement of the cylindrical shank 25 of the pin with the cylindrical bore of bushing 18. It will be noted that there is not any metal-to-metal contact between relatively movable parts in the pivotal structure. The withdrawal of pin 22 from its operative inserted position is prevented by lock nut 26 which is mounted on the projecting free end portion of shank 25 preferably in abutting relationship with the supplementary flange 7.

Rubber Blocks

While two or more rubber blocks may be used for cushioning the rocking movement, preferably three blocks 29, 30 and 31 are employed, one block 29 at the front of the rocker box and the other two blocks 30, 31 at the rear. All three rubber blocks are in a partially compressed condition when the box is in its neutral or "chair-unoccupied" position. The amount of the initial compression and the durometer of the rubber are matters primarily of the designer's choice. We have found a durometer of 55 and a neutral position compression of ⅛th of an inch in a cylindrical block 2" long having an outside diameter of 2" and a center bore diameter of ½" gave very satisfactory results in one very satisfactory embodiment of a lightweight chair equipped with a rocker box made in accordance with this invention. With substantial increases in chair weight and size, substantial increase in durometer will normally be in order.

The front rubber block 29 preferably tapers from its transverse center, which we assume to be 2" in diameter, to an end diameter of 1½". This taper is designated 33 on the drawings. The rear blocks 30, 31 preferably are not tapered.

Figure 9:
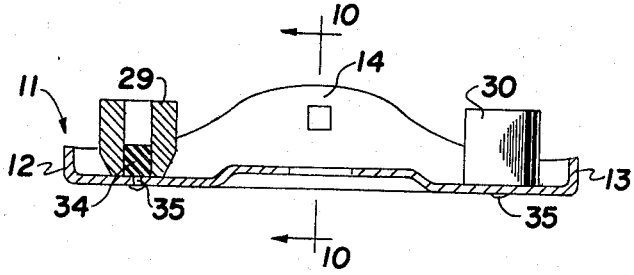
FIG. 9 is a vertical longitudinal center section of the bottom plate of the R-B, this view, which corresponds to one taken along line 9—9 of FIG. 5, shows the front tapered rubber block and the block restraining pin in section.

Each block is retained in position by a pin 34 dimensioned to fit snugly within the lower end of the center bore and to extend upwardly for a suitable distance, say, ½". Each pin has a center trunnion 35 of reduced diameter dimensioned to extend downwardly through an opening in the bottom plate 11 and to project sufficiently therefrom to permit the lower end of the pin to be expanded or peened sufficiently to rivet the pin 34 rigidly to the bottom plate as seen in FIG. 9.

Plate Type Swivel

The rocker box is mounted for rotation about a vertical center axis by means of a swivel composed of a pair of horizontal swivel plates which include the bottom plate 11 of the rocker box and an underlying base plate 38 which is of general concave-convex shape with its convex side facing upwardly. The base plate 38 of the swivel is formed with a horizontally extending upwardly bulging bead 39 to provide on the inner side of the head a race for an endless series of ball bearings 40. The bottom plate 11 has a cooperative race providing bead 41. The swivel plates are centrally secured together by a center bolt 42 and nut 43.

My application Ser. No. 729,902 filed Oct. 6, 1976 which issued on Feb. 28, 1978 as U.S. Pat. No. 4,076,346, discloses face-to-face plate-type swivels which may be substituted for the plate-type swivel described and illustrated in this application.

Base Supporting Structure

The base supporting structure has a suitable number of downwardly-open channel-shaped legs 46, the bights of which are secured to the underside of the base plate 38 of the swivel. The legs decline outwardly from base plate 38 toward the floor. Their floor-engaging ends carry floor-engaging Nylon glides 47. Each glide has, on its bottom side above its floor-engaging area, a transverse groove 48 to receive tongues 49 struck from opposite sides of the corresponding leg and bent inwardly into the groove sufficiently to press the glide 47 upwardly into rigid engagement with the bight of the leg channel. The glides 47 are made of opaque Nylon, a well known type of Nylon which has a high resistance to abrasion and wear and which, therefore, retains a long lasting smooth finish.

Miscellaneous

While it is essential that the top plate be continuously flanged, the bottom plate may or may not be continuously flanged although continuous flanging is desirable for purposes of durability. The top and bottom plates may vary in size from the 6+ inch size specifically stated hereinbefore. The pivot pins may be reversed to extend outwardly from their head ends rather than inwardly as shown. When reversed, the pins are, of course, non-rockably connected to square pivot-receiving holes in the inner depending side flanges.

For the sake of clarity, the term "rubber block" as used in any original claim, is used to promote clarity but it should be understood that it is intended to embrace any equivalent resiliently yieldable non-metallic material. Also rubber block durometers up to about 70 are presently contemplated for use in substantially larger and heavier chairs.

Having described my invention, I claim:

1. A rocker box for furniture and the like, comprising:

A. a rockable top plate having 1. two pairs of parallel laterally-spaced outer-depending side and inner-depending supplementary flanges containing perforations cooperatively providing four pivot-receiving openings on a common transverse axis,
   a. one outer side and one inner supplementary flange being located at each of the opposite sides of the box,
   b. each inner supplementary flange being spaced inwardly from the corresponding outer side flange so as to cooperate therewith in delimiting an interposed upper flange space;

B. a non-rockable bottom plate having, throughout its periphery, an endless upright rim providing peripheral side flanges and also providing upright front and rear flanges and further having 1. one pair of parallel laterally-spaced outer upright side flanges extending upwardly from said pheripheral side flanges, one for each upper flange space,
   a. each upright side flange projecting upwardly from the bottom plate into the corresponding upper flange space where it is parallel to the corresponding depending side and supplementary flanges,
   b. said pair of upright side flanges cooperatively providing two more pivot-receiving openings on said common transverse axis; and C. means mounting the top plate upon the bottom plate for rocking movement out of a neutral position between extreme forward and rearward rocking positions, 1. said means including a pair of laterally-spaced flange-interconnecting pivotal structures, one pivotal structure at each side of the box.

2. The rocker box of claim 1 wherein:
A. said top plate has, throughout its periphery, an endless depending rim not only containing said outer-depending side flanges but also providing depending front and rear flanges; and
B. said endless depending and upright rims of the top and bottom plates are each contoured to provide front and rear flanges which are vertically shorter than their corresponding perforated outer side flanges.

3. The box of claim 1 wherein:
A. each pivotal structure includes a bushing non-rockably mounted in a pivot-receiving opening of an upright side flange so that the non-rockable bottom plate cooperates with both bushings to form an integrated bottom unit.

4. The box of claim 1 wherein:
A. said pivotal structures have a pair of pivot pins pivoted on said common axis, one at each side of the box,
1. each of said pivot pins is non-rockably supported at its opposite ends in the pivot-receiving openings of a pair of adjacent outer side and inner supplementary flanges so that the rockable top plate cooperates with both pins to form an integrated top plate unit rockably mounted on the bottom plate.

5. The box of claim 1 wherein:
A. each pivotal structure includes a bushing non-rockably mounted in a pivot-receiving opening of an upright side flange so that the non-rockable bottom plate and both of its bushings cooperate to form an integrated non-rockable bottom plate unit; and
B. said pivotal structures have a pair of pivot pins pivoted on said common axis, one at each side of the box,
1. each of said pivot pins is non-rockably supported at its opposite ends in the pivot-receiving openings of a pair of adjacent outer side and inner supplementary flanges so that the rockable top plate and both of its pins cooperate to form an integrated rockable top unit rockably mounted on the bushings of said integrated bottom plate unit.

6. The box of claim 5 wherein:
A. each bushing has a cylindrical bore;
B. each pivot pin has a cylindrical shank; and
C. said integrated top unit is rockably mounted on said integrated bottom unit by fitting the cylindrical shank of each pivot pin rotationally within the cylindrical bore of the corresponding bottom plate bushing.

7. The box of claim 5 wherein:
A. each upright side flange on the bottom plate extends upwardly into the corresponding flange space of the top plate;
B. the pivot-receiving opening in each upright flange of the bottom plate is in the form of a square hole; and
C. each bushing
1. extends across the adjacent flange space between depending side and supplementary flanges,
2. is formed with a head at one end and a square shank, and
3. is non-rotatably mounted on the bottom plate by fitting its square shank into said square hole on the corresponding upright flange of the bottom plate.

8. The box of claim 5 wherein:
A. the pivot-receiving opening in one depending flange of each pair of side and supplementary flanges on the top plate is in the form of a square hole; and
B. each pivot pin
1. is formed with a head at one end, a smaller square shoulder next to its head and a still smaller cylindrical shank, and
2. is non-rotatably mounted on one depending flange of each pair on the top plate by fitting its square shoulder into said square hole of said depending flange.

9. The box of claim 8 wherein:
A. each upright side flange on the bottom plate extends upwardly into the corresponding flange space of the top plate;
B. the pivot-receiving opening in each upright flange of the bottom plate is in the form of a square hole; and
C. each bushing
1. extends across the adjacent flange space between depending side flanges,
2. is formed with a head at its outer end and a square shank, and
3. is non-rotatably mounted on the bottom plate by fitting its square shank into said square hole on the corresponding upright flange of the bottom plate.

10. The box of claim 9 wherein:
A. the cylindrical shank of each pivot pin fits rotationally within the cylindrical bore of the corresponding bushing and projects through the pivot-receiving opening in the other depending flange of the adjacent pair of depending side and supplementary flanges.

11. The box of claim 1 including:
A. at least two rubber blocks arranged within the front and rear portions of the box normally in a slightly compressed condition for cushioning the back and forth rocking movement of the top plate,
1. the opposite ends of the front block normally engaging the top and bottom plates.

12. The box of claim 11 wherein said rubber blocks comprise:
A. two laterally spaced rubber blocks in the rear portion of the box; and
B. one tapered rubber block in the front portion thereof.

13. The rocker box of claim 1 further comprising
A. means mounting said rocker box for rotation about a vertical center axis by means of a swivel composed of a pair of horizontal swivel plates which include said bottom plate of the rocker box and an underlying base plate with bearings therebetween; and
B. a base supporting structure having
1. several downwardly-open channel-shaped legs secured to the base plate to decline outwardly therefrom toward the floor,
2. a Nylon glide in the floor-engaging end of each leg, each glide having, on its bottom side above its floor-engaging area, a transverse groove, and
3. a pair of tongues struck from opposite sides of the corresponding leg to extend transversely into the groove sufficiently to engage and press the glide upwardly into rigid engagement with the bight of the leg channel.

14. The rocker box of claim 1 wherein:
A. said top plate has, throughout its periphery, an endless depending rim not only containing said outer-depending side flanges but also providing depending front and rear flanges.

* * * * *